US007683854B2

(12) United States Patent
Sievenpiper et al.

(10) Patent No.: US 7,683,854 B2
(45) Date of Patent: Mar. 23, 2010

(54) TUNABLE IMPEDANCE SURFACE AND METHOD FOR FABRICATING A TUNABLE IMPEDANCE SURFACE

(75) Inventors: Daniel F. Sievenpiper, Los Angeles, CA (US); Thomas K. Dougherty, Playa Del Rey, CA (US); John J. Drab, Santa Barbara, CA (US); Solomon O. Robinson, Oxnard, CA (US)

(73) Assignee: Raytheon Company, Waltham, MA (US)

( * ) Notice: Subject to any disclaimer, the term of this patent is extended or adjusted under 35 U.S.C. 154(b) by 930 days.

(21) Appl. No.: 11/350,429

(22) Filed: Feb. 9, 2006

(65) Prior Publication Data

US 2007/0182639 A1 Aug. 9, 2007

(51) Int. Cl.
*H01Q 15/02* (2006.01)

(52) U.S. Cl. ..... 343/909; 343/700 MS; 455/193.1

(58) Field of Classification Search ..... 343/700 MS, 343/909 S, 909; 455/193.1
See application file for complete search history.

(56) References Cited

U.S. PATENT DOCUMENTS

| | | | | |
|---|---|---|---|---|
| 6,101,102 | A | 8/2000 | Brand et al. | |
| 6,316,651 | B1 | 11/2001 | Dougherty et al. | |
| 6,483,480 | B1 | 11/2002 | Sievenpiper et al. | |
| 6,538,621 | B1 | 3/2003 | Sievenpiper et al. | |
| 6,552,696 | B1 | 4/2003 | Sievenpiper et al. | |
| 6,646,605 | B2 * | 11/2003 | McKinzie et al. | 343/700 MS |
| 6,864,843 | B2 * | 3/2005 | du Toit et al. | 343/700 MS |
| 7,068,234 | B2 * | 6/2006 | Sievenpiper | 343/745 |
| 7,071,888 | B2 * | 7/2006 | Sievenpiper | 343/745 |
| 7,369,828 | B2 * | 5/2008 | Shamsaifar | 455/193.1 |

* cited by examiner

*Primary Examiner*—Tan Ho
(74) *Attorney, Agent, or Firm*—Christie, Parker & Hale, LLP

(57) ABSTRACT

A tunable impedance surface includes a varactor. The varactor comprises a bottom electrode formed on a surface of a substrate. First and second ferroelectric elements are on top of the bottom electrode and electrically connected to one another through the bottom electrode. A first top electrode is on top of and electrically connected to the first ferroelectric element and a second top electrode is on top of and electrically connected to the second ferroelectric element.

8 Claims, 9 Drawing Sheets

FIG. 1A
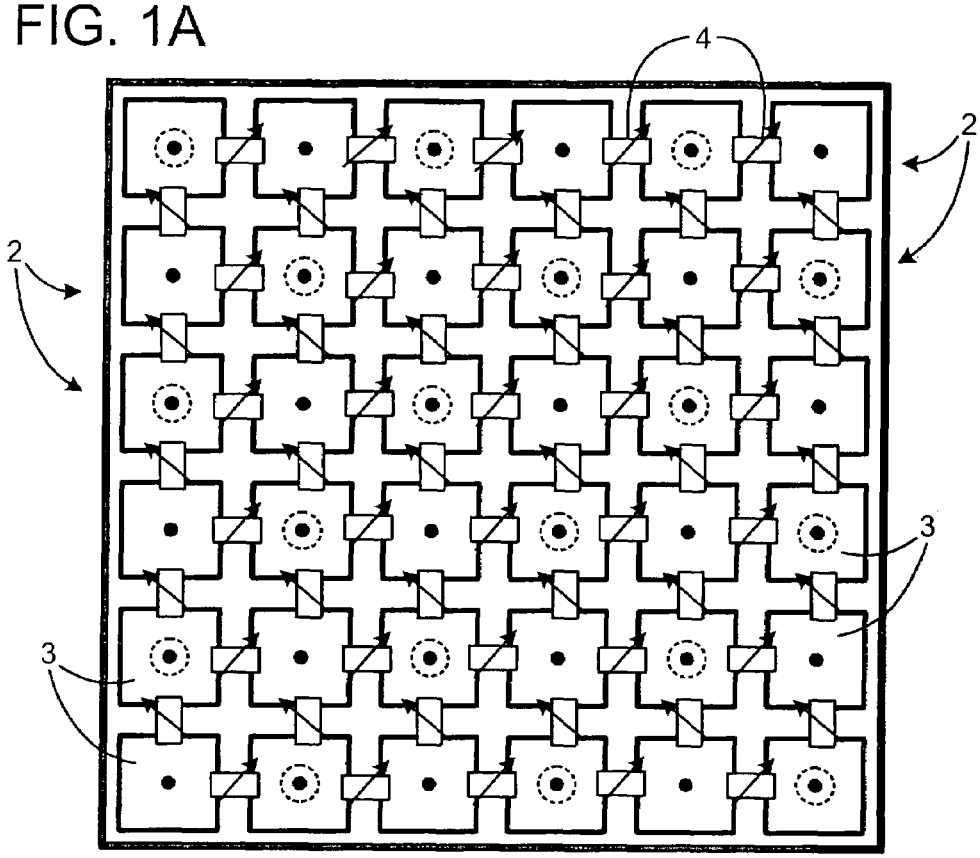
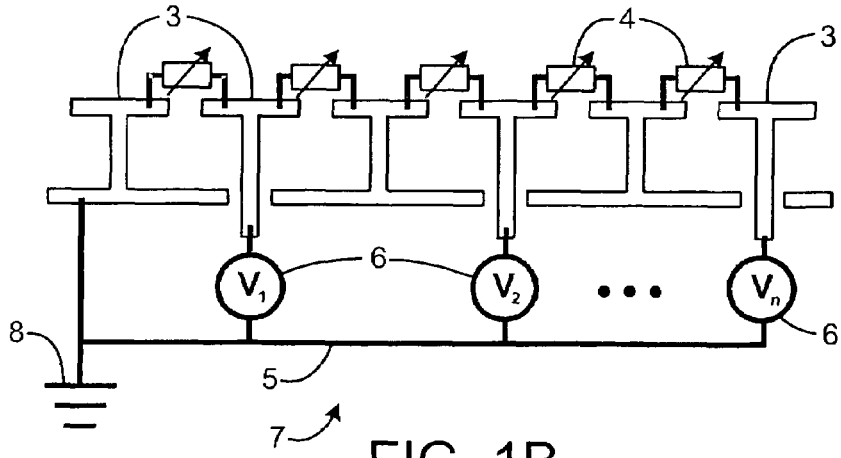
FIG. 1B

TUNABLE IMPEDANCE SURFACE AND METHOD FOR FABRICATING A TUNABLE IMPEDANCE SURFACE

BACKGROUND OF THE DISCLOSURE

Phased-array antenna architecture includes a number of individual, active antenna elements, associated control electronics, a beam forming network including phase shifters and power combiners, and a complex assembly. The cost of such a phased array architecture may be dominated by the number of individual elements.

A tunable impedance surface for steering and/or focusing a radio frequency beam is described in commonly-assigned U.S. Pat. Nos. 6,483,480, 6,552,696 and 6,538,621 to Sievenpiper et al.

SUMMARY

A tunable impedance surface includes a varactor. The varactor comprises a bottom electrode formed on a surface of a substrate. First and second ferroelectric elements are on top of the bottom electrode and electrically connected to one another through the bottom electrode. A first top electrode is on top of and electrically connected to the first ferroelectric element and a second top electrode on top of and electrically connected to the first ferroelectric element.

BRIEF DESCRIPTION OF THE DRAWINGS

Features and advantages of the disclosure will readily be appreciated by persons skilled in the art from the following detailed description of exemplary embodiments thereof, as illustrated in the accompanying drawings, in which:

FIG. 1 illustrates a simplified circuit diagram of an exemplary embodiment of a tunable surface.

DETAILED DESCRIPTION OF THE DISCLOSURE

Figure 2:
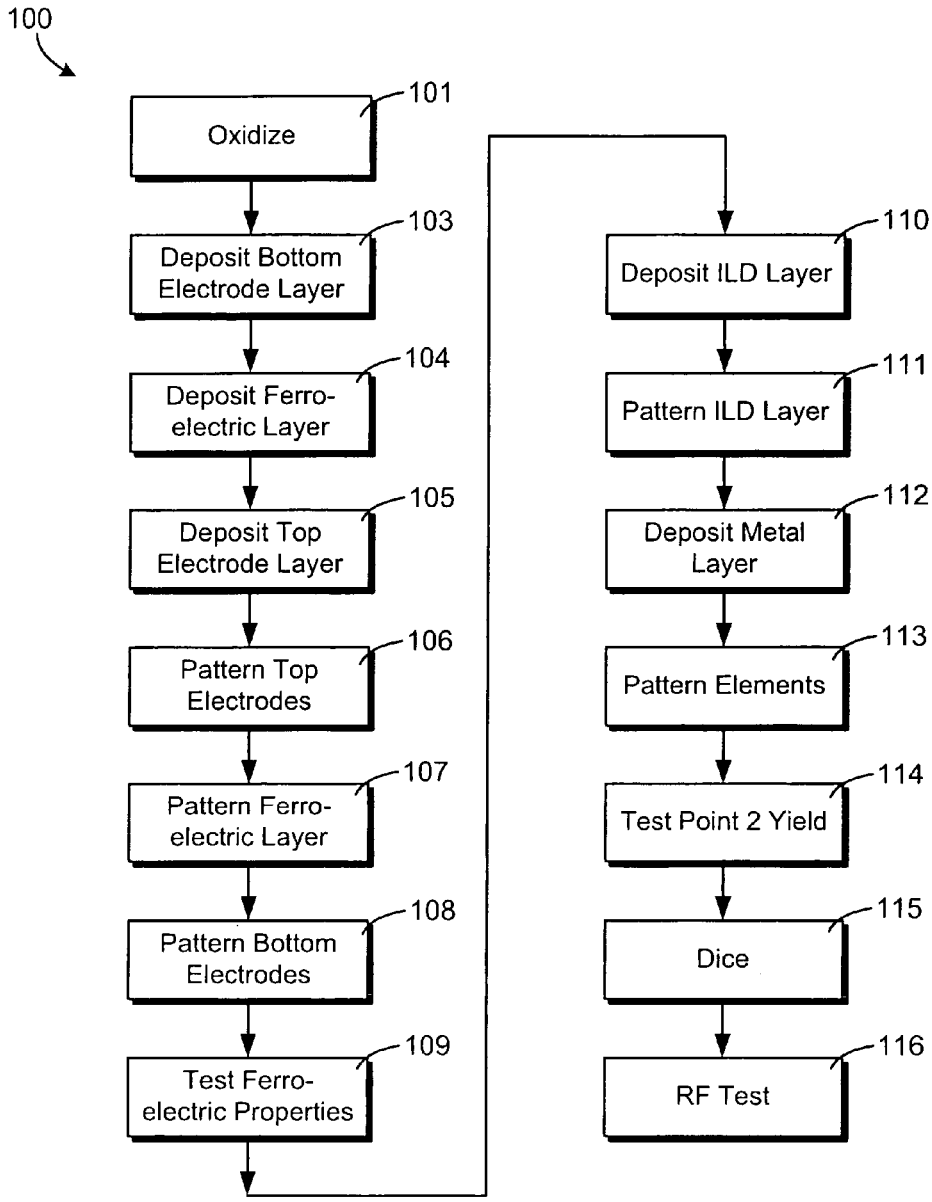
FIG. 2 illustrates an exemplary method for fabricating a varactor.

In the following detailed description and in the several figures of the drawing, like elements are identified with like reference numerals.

FIG. 1A illustrates a simplified circuit diagram of an exemplary embodiment of a tunable surface 1. In an exemplary embodiment, a tunable surface may be used in an electronically steerable antenna (ESA). The tunable surface 1 may be made using a monolithic fabrication process 100 (FIG. 2) as discussed below. The antenna may be capable of steering a beam of microwave or millimeter wave energy in one or two dimensions, using a set of electrical control signals. The antenna may include a substrate 202 (FIG. 3), a ground plane 308, 08 (FIGS. 4A, 4B, 5A and 5B) on the back of the substrate, a periodic metallic pattern 2 on the front of the substrate, metal elements or patches 3 within the metallic pattern 2 are separated by varactors 4, variable reactance devices, which comprise a ferroelectric material, e.g. barium strontium titanate (BST), a set of voltage control lines 5 (FIG. 1B) that are attached to the periodic metallic pattern 1 and that apply a set of bias voltages 6 to the varactors 4, and a circuit 7 that supplies the control voltages 6.

FIG. 1B illustrates a simplified circuit diagram of the exemplary embodiment of FIG. 1A. In an exemplary embodiment, a tunable surface 1 may include a ground plane 308, 508 (FIGS. 4A, 4B, 5A and 5B) connected to ground 8 and a series of metallic metal elements or patches 3. The patches 3 may be separated from the ground plane by a substrate 202 (FIG. 3) and the substrate may be perforated by a series of vertical vias 310, 410 (FIGS. 4A, 4B, 5A and 5B) that supply the control voltages 6 to the patches 3. The patches 3 may be interconnected with their neighbors by the varactors 4. The varactors 4 may allow the capacitance between the neighboring patches to be controlled with the applied control voltages 6 to each patch 3. Half of the patches may be connected to ground 8, in a metallic pattern 2 (FIG. 1A) which, in an exemplary embodiment, may be a checkerboard pattern. In an exemplary embodiment, only half of the patches are attached to bias lines 5. In an exemplary embodiment, the substrate may be a silicon wafer, and the patches 3 and ground plane may be of any metal, e.g., platinum (PT) which may be coated with aluminum. The varactors 4 may be made using a metal-BST-metal layer structure as described below.

FIG. 2 illustrates an exemplary method 100 for fabricating a variable reactance or varactor. In an exemplary embodiment, the varactor may be a variable reactance device and may have a capacitance which varies depending on a control voltage provided. In an exemplary embodiment, a varactor structure may comprise a plurality of individual varactors combined in parallel or series. In an exemplary embodiment, a varactor may be tunable, in that the capacitance of a particular varactor structure may be tuned to a known or desired capacitance by application of a corresponding control voltage to the varactor. In an exemplary embodiment, a varactor formed by the method 100 of FIG. 2 may be incorporated into a tunable impedance surface used in an electronically steerable array (ESA)antenna.

In exemplary embodiment, the method 100 may include oxidizing 101 a substrate which may be a silicon wafer. The method may include depositing 103 a metal layer on a surface of the substrate. In an exemplary embodiment, the metal layer may be a Ta layer and/or a Ta/Pt layer.

In an exemplary embodiment, the metal layer may be an adhesion layer deposited on the oxidized silicon substrate. This Ta layer may be oxidized in the process. The thickness of the Ta layer may be about 200 A and preferably between 100-500 A. In an exemplary embodiment, the evaporated deposited Pt layer may be about 2500 A and preferred between 1000 A and 10000 A.

In an exemplary embodiment, the method 100 may also include depositing 104 a layer of ferroelectric material. In an exemplary embodiment, the ferroelectric material may be barium strontium titanate (BST). In an exemplary embodiment, the ferroelectric material may be between 500-30000 A thick, for example about 2000 A. In an exemplary embodiment, the ferroelectric material may include Ba(1-x) Sr(x) Ti O3 (BST) with x to be about 0.5 as the active ferroelectric material. This composition may be in the paraelectric phase at the operating temperature and does not show hysteresis in the polarization-electric field (P-E) characteristic. When operated as a paraelectric, the material shows a permittivity which varies as a function of applied voltage.

In an exemplary embodiment, the method 100 may include depositing 105 a top electrode layer over the layer of ferroelectric material. In an exemplary embodiment, the top electrode layer may include Pt. The top electrode may be, for example, evaporated Pt with a thickness within a range from 200-5000 A thick, for example about 1000 A.

Figure 3A:
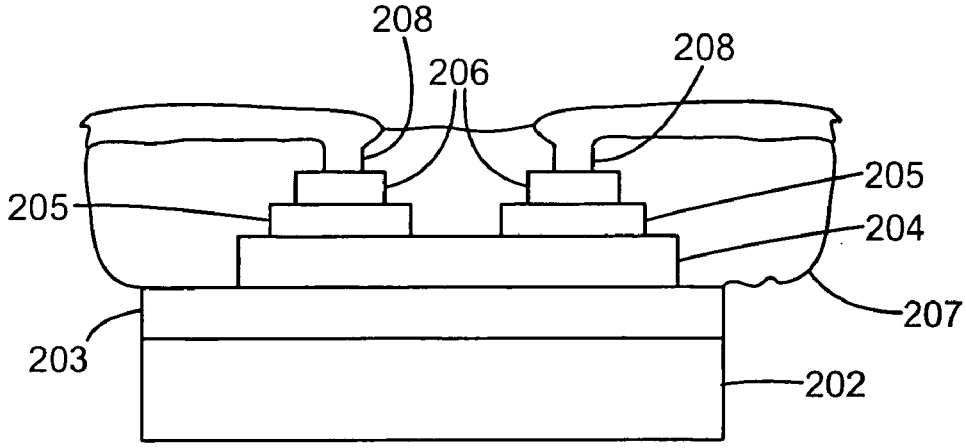
FIG. 3A illustrates a side-view, cross-sectional view of an exemplary embodiment of a varactor on a substrate.
Figure 3B:
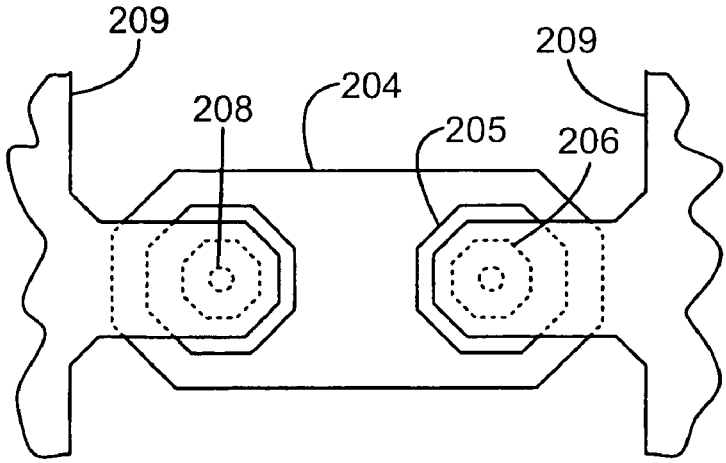
FIG. 3B illustrates a top-view of an exemplary embodiment of a varactor on a substrate.

In an exemplary embodiment, the top electrode layer may be patterned 106 to form at least one top electrode for each varactor to be formed. Patterning 106 the top electrode layer may include standard photolithography techniques or any other appropriate technique. An exemplary method may also include patterning 107 the ferroelectric layer to form individual ferroelectric elements to be incorporated into varactors. In an exemplary embodiment, the varactors to be formed may include more than one individual ferroelectric element as shown in FIGS. 3A and 3B below.

In exemplary embodiment, the method 100 may include patterning 108 the bottom electrode. In an exemplary embodiment, the bottom electrode may form an electrical connection between more than one individual ferroelectric elements which may work together as a single varactor. In an exemplary embodiment, the bottom electrode layer may be patterned using standard photolithography techniques or any other appropriate technique.

In an exemplary embodiment, the ferroelectric properties of the varactors may be tested 109, for example by measuring the capacitance of the varactors corresponding to various applied control voltages. The testing may be performed by measuring the capacitance as a function of bias voltage. The tuning is the large difference in capacitance as the bias voltage is changed. The bias voltage may be applied with a low voltage DC power supply. The capacitance may be measured by interrogation with a small AC signal (about 35 millivolts) using an LCR meter. Testing may be desirable, for example, where the varactor is incorporated into, or is to be incorporated into, a tunable, textured array, for example an electronically steerable array (ESA), which may be incorporated into an antenna. The results of the tests may be stored, for example in a memory, and may be used for capacitance tuning. The properties of the varactor, or plurality of varactors, may be stored for use in tuning the array, as described in more detail below.

In an exemplary embodiment, a layer of inter-layer dielectric (ILD) may be deposited 110. The ILD may be, for example, CVD (chemical vapor deposited) SiO2 made from reaction of silane and oxygen in a low pressure CVD reactor. The entire surface of the wafer (which is now patterned capacitors) is coated. The thickness of the ILD LPCVD SiO2 layer may be from about 1000 to 6000 A thick, for example about 3000 A thick. The layer of ILD may be patterned 111 to define openings through the ILD through which electrical contact may be made between the top electrodes of a varactor and a subsequent metal layer to be deposited over the ILD.

In an exemplary embodiment, a layer of metal may be deposited 112 over the ILD layer. The metal layer may be patterned 113 to define individual elements of a tunable surface which may be electrically connected to neighboring elements through the varactors. In an exemplary embodiment, one of two neighboring elements may be connected to ground and the other of two neighboring elements may be connected to a control voltage for tuning a tunable surface. In an exemplary embodiment, the elements may be electrically connected to contacts in the upper electrode layer through openings patterned in the ILD layer.

In an exemplary embodiment, the varactors may be tested 114 to confirm electrical operation and integrity of the entire structure before further processing and test. In an exemplary embodiment, a plurality of varactors are fabricated on a surface in a pattern or array which may be incorporated into a tunable textured surface. In an exemplary embodiment, the wafer may be diced 115 into chips. In an exemplary embodiment, a wafer is diced 35 into individual chips after the varactors and the RF surface and, in some instances, the DC control surface of a tunable, textured surface have been fabricated on the same wafer. In an exemplary embodiment, the RF properties of each of the separate devices formed by dicing the wafer may be tested 116.

In an exemplary embodiment, testing 116 may include an RF test provided by irradiating the device with a suitable RF signal, for example a wave guide aperture, and receiving the reflected signal with a suitable receiver, for example a horn antenna. The RF phase and scanning of the reflected signal is variable by adjustment of the bias voltage set across the individual elements.

FIGS. 3A and 3B illustrate a cross-sectional view and a top view, respectively, of an exemplary varactor 201 formed by a method which may be similar to the method 100 described above with respect to FIG. 2. An exemplary varactor 201 may be formed on a surface of a substrate 202. In an exemplary embodiment, the substrate 202 may have an SiO2 layer 203 which may have been formed during an oxidize 101 (FIG. 2) step described above. In an exemplary embodiment, the substrate 202 may be a high resistivity silicon substrate.

In an exemplary embodiment, the varactor 201 may include a bottom electrode layer 204. The bottom electrode layer may be deposited 103 as part of a bottom electrode layer and patterned 108 as discussed above with respect to FIG. 2. In an exemplary embodiment, the bottom electrode 204 may include Ta/Pt or tantalum and platinum.

In an exemplary embodiment, a varactor structure 201 may also include a ferroelectric element 205, for example BST. In an exemplary embodiment, the ferroelectric element may be deposited 104 as part of a ferroelectric layer and patterned 107 (FIG. 2) to define a ferroelectric element 205. In an exemplary embodiment, the varactor 201 may include more than one, for example, two individual varactor elements which act in series. For example, the varactor 201 may include two ferroelectric elements 205 electrically connected through the bottom electrode 204.

In an exemplary embodiment, a varactor 201 may include a top electrode 206. In an exemplary embodiment, the top electrode 206 may be deposited as part of the top electrode layer which may be patterned 106 (FIG. 2) to form the top electrode 206.

In an exemplary embodiment, the varactor 201 may include two top electrodes—one on each of two ferroelectric elements 205. In an exemplary embodiment, the top electrodes 205 may include platinum or Pt. In an exemplary embodiment, the top electrodes 206 may provide an electrical connection point for connecting neighboring tunable surface elements through the varactor 201.

In an exemplary embodiment, the ferroelectric elements 205 may be octagonal-shaped and may be sandwiched between octagonal-shaped top electrodes 206 and an elongated bottom electrode 204.

In an exemplary embodiment, an ILD layer 207 may be deposited 110 (FIG. 2) over the top of the varactor 201. In an exemplary embodiment, the ILD layer may be low pressure chemical vapor deposit (LPCVD) SiO. In an exemplary embodiment, the ILD layer 207 may be patterned 111 (FIG. 2) to define the openings where contacts 208 may be formed when a metal layer is deposited 112 (FIG. 2).

In an exemplary embodiment, neighboring elements 209 may be electrically connected with each other through the varactor 201. In an exemplary embodiment, the elements 209 may be formed by depositing 112 and patterning 113 a metal layer over the ILD layer. In an exemplary embodiment, the elements 209 are electrically connected to the top electrodes 206 at contacts 208. In an exemplary embodiment, one of the elements 209 may be connected to ground and the other may be connected to a control voltage as illustrated below, with respect to FIGS. 4A, 4B, 5A and 5B.

In an exemplary embodiment, having a varactor 201 with more than one individual ferroelectric elements 205 in series connected through a lower electrode 204 may permit the neighboring elements 209 to be deposited and formed from a single layer of metal. In an exemplary embodiment, forming the elements 209 with a single layer of metal may improve manufacturing efficiency.

Figure 4A:
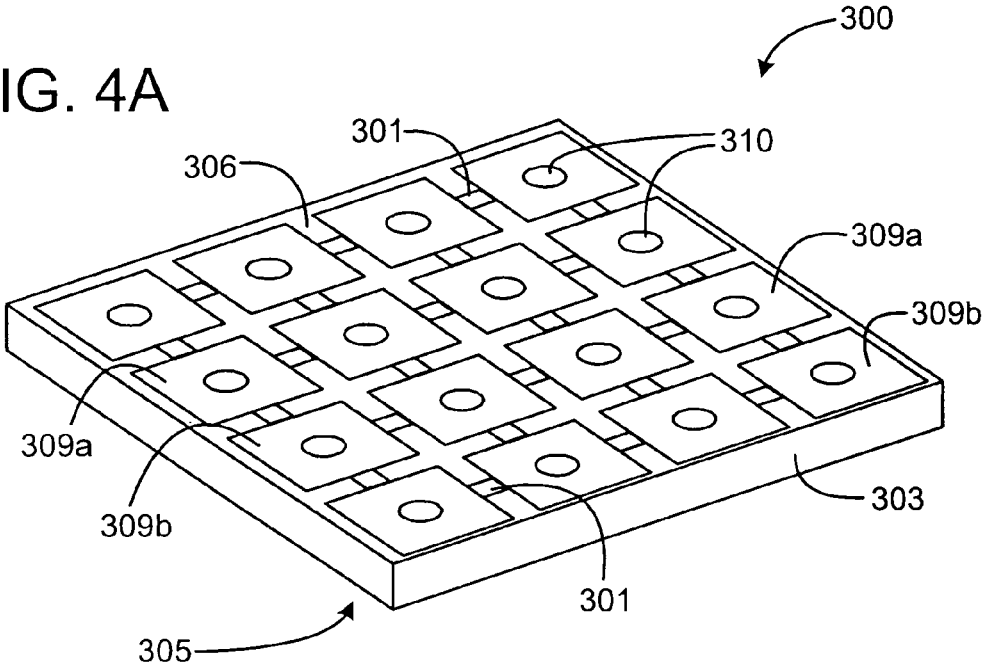
FIG. 4A illustrates a plan view of an exemplary embodiment of a single-wafer tunable surface.
Figure 4B:
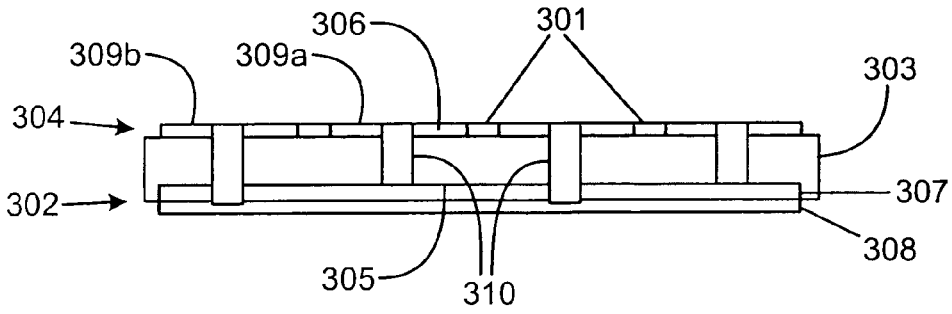
FIG. 4B illustrates a side-view, cross-sectional view of an exemplary embodiment of a single-wafer tunable surface.
Figure 8:
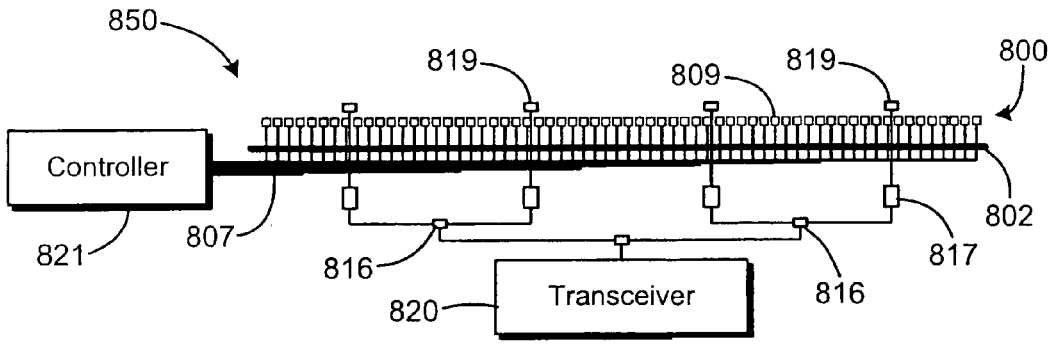
FIG. 8 illustrates an exemplary embodiment of an electronically scanned array with a tunable surface.
Figure 9:
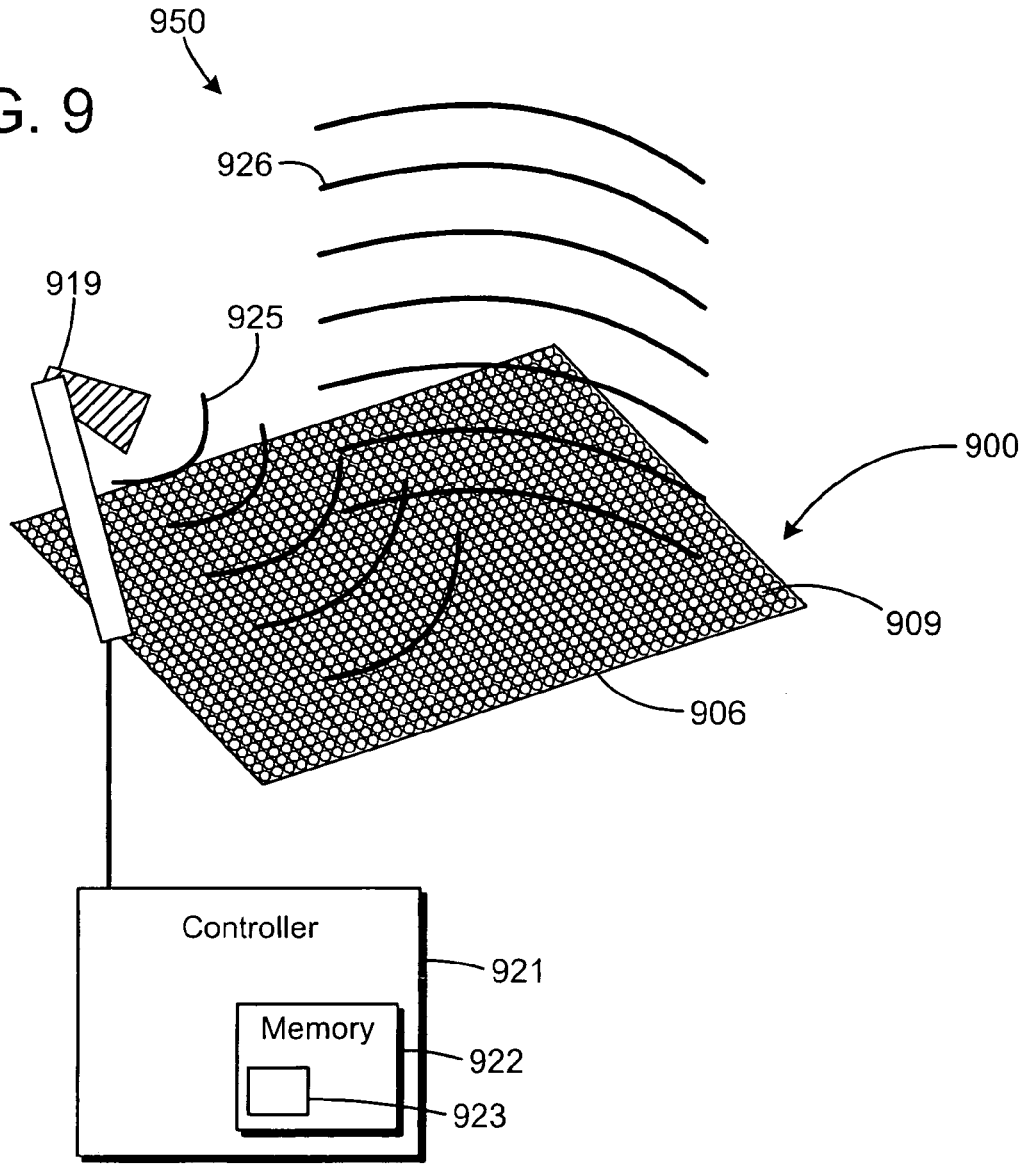
FIG. 9 illustrates an exemplary embodiment of an electronically scanned radar with a tunable surface.

In an exemplary embodiment, a plurality of varactors 301 may be incorporated into a two-dimensional electronically tunable impedance surface 300 as shown in FIGS. 4A and 4B. FIGS. 4A and 4B illustrate a diagrammatic isometric view and a simplified cross-sectional view, respectively, of an exemplary embodiment of a tunable surface 300 incorporating a plurality of BST varactors 301. Two-dimensional electronically tunable impedance surfaces may be incorporated into electronically steerable array (ESA) antennas, as illustrated in FIGS. 8 and 9 below.

In an exemplary embodiment, the tunable surface 300 may include a DC control circuit portion 302 arranged on one surface of a substrate 303 and an RF portion 304 arranged on another surface of the substrate 303. In the exemplary embodiment of FIGS. 4A and 4B, for example, the DC control circuit portion 302 may be arranged on a back or bottom surface 305 of the substrate 303 and the RF portion 304 is arranged on the front or top surface 306 of the same substrate 303.

Figure 5A:
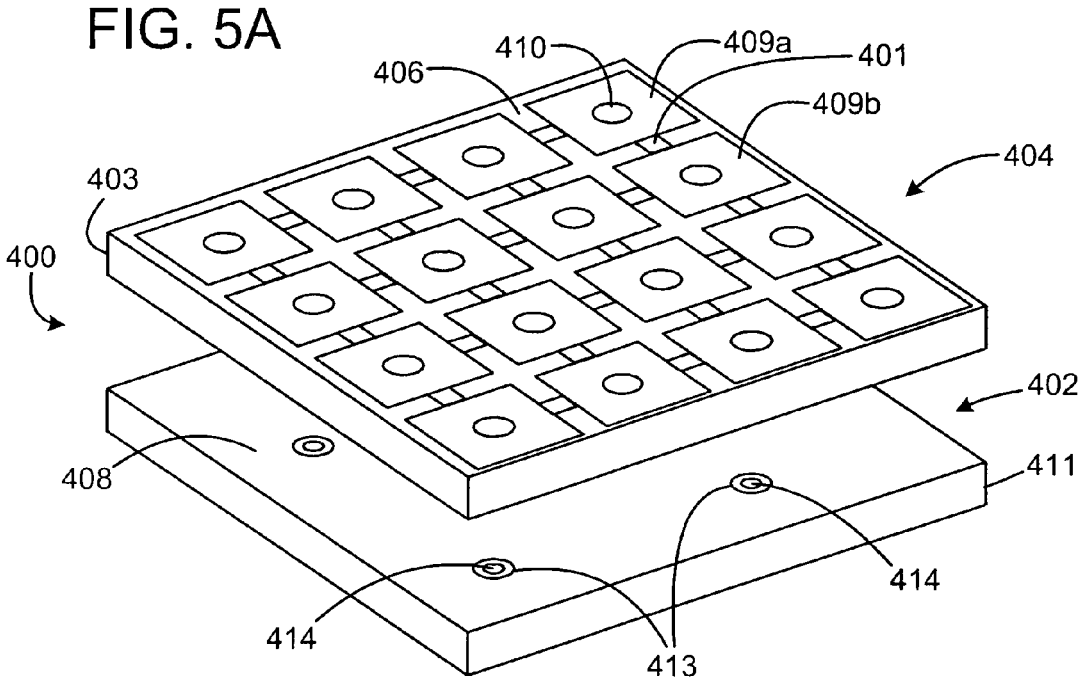
FIG. 5A illustrates a plan view of an exemplary embodiment of a two-wafer tunable surface.
Figure 5B:
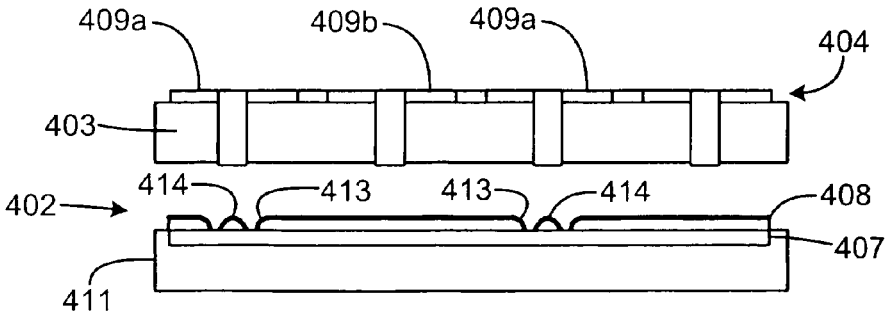
FIG. 5B illustrates an exploded cross-sectional view of an exemplary embodiment of a two-wafer tunable surface.

In alternate exemplary embodiments, illustrated, for example in FIGS. 5A and 5B below, the DC control portion 402 may be fabricated on a surface of one substrate and the RF portion 404 may be fabricated on a surface of another substrate, which may be bonded or connected to make the electrical connections between the two portions (FIGS. 5A, 5B).

Referring again to FIGS. 4A and 4B, the DC control portion may include DC control circuits 307 with bias or control lines for providing a bias or control voltage to the RF portion 304 of the surface. In an exemplary embodiment, the control circuits 307 may include control or bias lines arranged to provide for row-and-column addressing, such as may be used in a flat panel display.

In an exemplary embodiment, the DC control portion may include a ground plane 308. In an exemplary embodiment, the ground plane 308 may be deposited over the control circuits 307 on the bottom surface 305 of the substrate 303. In exemplary embodiment, the ground plane 308 and the control circuits 307 may be separated by an insulating layer which may be patterned and etched to permit the appropriate ground connections as desired.

In an exemplary embodiment, the RF portion may include a plurality of elements 309*a*, 309*b*.In an exemplary embodiment, the elements 309*a*, 309*b* may be metal plates or patches. In an exemplary embodiment, the elements 309*a*, 309*b* may be arranged in a periodic formation and connected with neighboring elements 309*b*, 309*a* through varactors 301. In an exemplary embodiment, the elements 309*a*, 309*b* may be deposited 112 and patterned 113 as part of the metal layer as discussed above with respect to FIG. 2.

In an exemplary embodiment, the RF portion 304 is separated from the DC control portion 302 by the substrate 303. The RF portion 304 may be electrically connected to the DC control portion 302 through conductive vias 310 through the substrate 303.

In an exemplary embodiment, the substrate 303 may be a silicon wafer, glass, quartz, alumina, ceramic, saphire (single crystal alumina), LAlO, MgO, NdGaO, YSZ or SrTiO3.In an exemplary embodiment, the thickness of the substrate 303 may be selected based on the desired operating frequency range. In an exemplary embodiment, the thickness of the substrate may be less than a wavelength of an operating frequency. In an exemplary embodiment, the thickness of the substrate may be related to the wavelength of the center frequency of a desired operating range by the equation:

$$t=B\lambda/2\pi$$

t=thickness; B=bandwidth; λ=wavelength

In an exemplary embodiment, the elements 309*a*, 309*b* and ground plane 308 may be any metal, for example platinum coated with aluminum. In an exemplary embodiment, the varactors 301 may be made using a metal-BST-metal layer structure as described above, with respect to FIGS. 2, 3A and 3B. In an exemplary embodiment, the elements 309*a*, 309*b* may be spaced apart from the ground plane by a distance less than the wavelength of an operating frequency to be used with the tunable surface 300.

In an exemplary embodiment, some of the elements 309*a* may be electrically connected to bias lines of the control circuits 307 through corresponding vias 310. In an exemplary embodiment, other elements 309*b* may be electrically connected to the ground plane 308 through corresponding vias 310. In an exemplary embodiment, the biased elements 309*a* and grounded elements 309*b* may be arranged in a checkerboard pattern in which half of the elements are biased elements 309*a* and the other half are grounded elements 309*b*.In an exemplary embodiment, biased elements 309*a* are connected to neighboring ground elements 309*b* through varactors 301. In an exemplary embodiment, the varactors 301 may be similar to varactors 301 described above with respect to FIGS. 3A and 3B.

In an exemplary embodiment, the control circuits 307 provide bias voltage to respective biased elements 309*a*.The varactors 301 allow the capacitance between the neighboring elements 309*a*, 309*b* to be controlled by controlling the voltage applied to each element 309*a*.A controller may be programmed to address particular elements 309*a* and provide bias voltages to particular elements 309*a* in a pattern to selectively steer a beam illuminating the surface.

In an exemplary embodiment, the control voltages applied by the control circuits 307 may be in a range from about 0 to 24 volts. In an exemplary embodiment, the control voltage applied may depend on the property of the ferroelectric layer used in the varactor. In an exemplary embodiment, control voltages may be as high as about 100 volts. In an exemplary embodiment, the maximum control voltage which may be applied may be limited, for example, by design and structural limitations of the controller and the control circuits with respect to the amount of voltage they can generate, provide, and/or apply. In an exemplary embodiment, a higher voltage may be suitable for higher transmission power. In an exemplary embodiment, the control voltage may be at least about 100 times greater than the RF voltage induced on the surface by the transmitted RF field.

In FIGS. 4A and 4B, only a few elements 3*a*, 3*b* are shown for purposes of illustration. In an exemplary embodiment, a large number of such elements may be used.

FIGS. 5A and 5B illustrate exploded, diagrammatic, isometric and side, cross-sectional views of an embodiment of a tunable surface 400 suitable for use in an electronically steerable array. The tunable surface may include an RF portion 404 on a surface 406 of one substrate 403, for example an RF substrate 403, and a DC control portion on a surface 412 of a second substrate 411, for example a DC substrate 411. In an exemplary embodiment, the substrates 403, 411 may be silicon substrates, for example silicon wafers, glass, quartz, alumina, ceramic, saphire (single crystal alumina), LAlO, MgO, NdGaO, YSZ or SrTiO3.

In an exemplary embodiment, the RF portion 404 may include elements 409*a*, 409*b* and varactors 401, arranged and fabricated similarly to those described above, with respect to FIGS. 4A and 4B. In an exemplary embodiment, the RF substrate 403 may include conductive vias 410, which may provide an electrical connection between the metal plates 409*a*, 409*b* of the RF portion 404 with corresponding DC control circuits 407 or the ground plane 408 in an assembled tunable surface.

In an exemplary embodiment, the DC control portion 402 includes DC control circuits 407 and a ground plane 408. In an exemplary embodiment, the control circuits 407 may be formed on a surface 412, for example a top surface of the DC substrate 411 and the ground plane 408 may be formed over the DC control circuits 407. In an exemplary embodiment, the ground plane 408 may be a metal layer with openings 413 to provide access for connecting control pads 414. In an exemplary embodiment, the control pads 414 may be part of the control circuits 407 and may provide an electrical connection from a control line to a corresponding via 410 in an assembled condition. In an exemplary embodiment, the ground plane 408 and the control circuits 407 may be separated by an insulating layer (not shown) which may be patterned and etched for making the control circuit connections as desired.

In an exemplary embodiment, the RF substrate 403 with the RF portion 404 of the tunable surface 400 may be attached or connected to the DC substrate 411 with and the DC control portion 402 by a bump bonding process.

Figure 6:
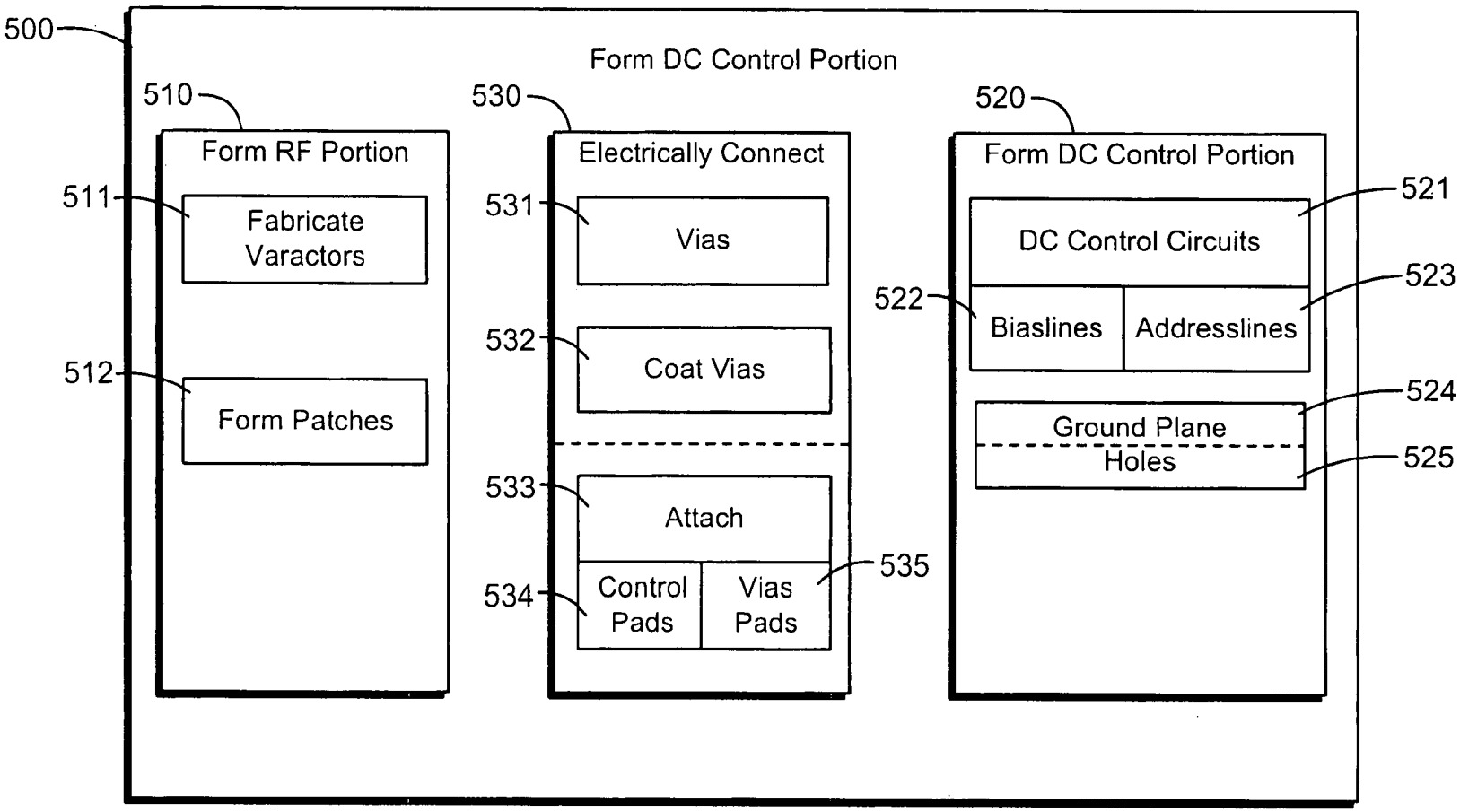
FIG. 6 illustrates an exemplary embodiment of a method for fabricating a tunable surface.

FIG. 6 illustrates an exemplary method 500 for fabricating a steerable, tunable textured surface. An exemplary embodiment includes forming 510 an RF portion on a surface of a substrate, forming 520 a DC control portion on a surface of a substrate, and electrically connecting 530 the RF portion to the DC control portion.

In an exemplary embodiment, forming 510 the RF portion may be a monolithic process on a single substrate. In an exemplary embodiment, forming 510 the RF portion includes fabricating 511 varactors. In an exemplary embodiment, the varactors are formed on top of a substrate and may be formed on a front or top surface of an RF substrate. In an exemplary embodiment, the varactors may be similar to and/or fabricated similarly as the varactors described above with respect to FIGS. 2, 3A and 3B.

In an exemplary embodiment, forming the RF portion includes forming 512 elements, which may be grounded elements and/or bias elements. In an exemplary embodiment, the elements may be deposited 112 (FIG. 2) as part of a metal layer and patterned 113 (FIG. 2) or etched to have the desired size and arrangement as desired, as described with respect to FIG. 2. In an exemplary embodiment, the elements are formed 512 after the varactors are formed 511. In an exemplary embodiment, the metal elements form a two-dimensional, checker-board lattice of metal elements. In an exemplary embodiment, forming 511 the varactors and forming 512 the elements forms a two-dimensional array of varactors and elements on a top surface of a substrate.

In an exemplary embodiment, forming 520 the DC control portion may be a monolithic process. The process may include, for example, forming 521 DC control circuits, which may include forming 522 bias lines and forming 523 address lines. The DC control circuits and bias lines may supply variable bias voltage to be provided to corresponding elements of the RF portion.

In an exemplary, one-substrate embodiment, forming the DC portion may include, for example, forming 521 the DC control circuits on a bottom or back surface of the same substrate on which the RF portion is formed. In an exemplary multiple-substrate embodiment, forming 520 the DC portion may include forming 521 the DC control circuits on a different substrate, for example a DC substrate, from the substrate on which the RF portion is formed. In an exemplary embodiment, the DC portion may be fabricated 520 on the front or top surface of the DC substrate. In an exemplary embodiment, the bias voltage corresponding to each pad may be programmed using row-and-column addressing, such as may be used in a flat panel display.

In an exemplary embodiment, forming 520 the DC control portion may include forming 524 a ground plane. In an exemplary one-substrate embodiment, forming 524 the ground plane may include forming 524 a metal layer over the DC control circuits on a back or bottom side of the substrate on which the RF portion is formed. In an exemplary multiple-substrate embodiment, the ground plane may be formed 524 over DC control circuits on a front or top surface of a DC control substrate. In an exemplary embodiment, forming 524 the ground plane may include forming 525 openings in the ground plane. In an exemplary embodiment, the openings in the ground plane may provide access to control pads for connecting the DC control circuits to the RF portion.

In an exemplary embodiment, electrically connecting 530 the RF portion with the DC control portion may comprise forming 531 vias in a substrate. In an exemplary embodiment, the vias may be formed 531 by drilling with a laser or etching using a wet or dry etch process. In an exemplary embodiment, the vias are formed 531 through the substrate on which the RF portion is formed.

In an exemplary embodiment, the vias are coated 532, filled or plated with metal to provide a conductive connection from an RF portion to a DC control portion. In an exemplary embodiment, the vias are coated 532 with metal to make conductive vias, which provide an electrical connection with the RF portion on the top surface of the substrate with a DC control portion, which may be on the bottom of the substrate or on the surface of a second, DC control substrate. In various exemplary embodiments, the vias may be formed 531 and/or metalized 532 either before or after the fabricating 511 the varactors and/or forming 512 the elements.

In an exemplary embodiment, the elements are electrically connected to corresponding conductive vias at or near the surface on which the RF portion is formed. In an exemplary one-substrate embodiment, the vias are electrically connected to a corresponding bias line or to the ground plane, as appropriate, at the opposite surface of the substrate, on which the DC control portion is formed.

In an exemplary multi-substrate embodiment, electrically connecting 530 the RF portion with the DC control portion may also include attaching 533 an RF substrate with a DC control substrate. In an exemplary embodiment, attaching 533 the RF portion with the DC control portion may be performed using a bump-attach or bump bonding process.

In an exemplary embodiment, electrically connecting 530 the RF portion with the DC control portion includes providing 534 via pads on the bottom surface of the RF substrate. The via pads may be electrically connected with vias and may facilitate the bump bonding process. In an exemplary embodiment, electrically connecting the RF portion with the DC control portion may also include providing 535 control pads on the DC control substrate. The control pads may be electrically connected with bias lines to be electrically connected with corresponding vias and/or elements on the RF substrate and may facilitate the bump attaché process 533. In an exemplary embodiment, the DC control circuits are electrically connected with corresponding vias and elements of the RF portion so that the array may be electronically steerable by a controller when assembled.

Figure 7:
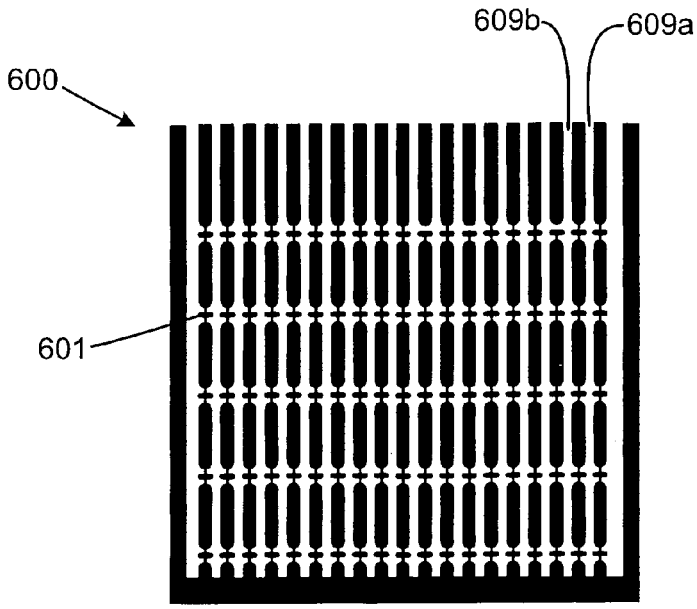
FIG. 7 illustrates an exemplary embodiment of a one-dimensionally steerable tunable surface.

In an exemplary embodiment, a varactor may be incorporated into a one-dimensionally steerable tunable, textured impedance surface 600. FIG. 7 illustrates a top-view of a one-dimensionally steerable tunable surface 600. In an exemplary embodiment, the tunable surface 600 may be incorporated as part of an antenna for a K-band, one-dimensionally steerable antenna array. In an exemplary embodiment, a tunable surface may not have an inherent frequency limit. In an exemplary embodiment, a surface may be used for frequencies as high as W-band, or perhaps higher. In an exemplary embodiment, there may be no lower frequency limit.

The metallic elements 609*a* supply bias voltage to rows of varactor structures 601. In an exemplary embodiment, each varactor structure 601 may be fabricated as a pair of varactors in series, similar to the exemplary embodiment of FIG. 3B above. In an exemplary embodiment, the elements 609*a*, 609*b* may be in the form of metallic lines, where each line is connected in parallel to a row of varactors 601 which lie between neighboring elements 609*a*, 609*b*.Bias voltages applied to the elements 609*a* change the voltage applied to the varactors 601, thereby altering the resonance frequency and reflection phase of the surface. Every other bias line 609*b* is grounded. In an exemplary embodiment, the bias voltages applied to alternating biased elements 609*a* may be controlled to give the tunable surface 600 a desired phase angle of reflection to incoming electromagnetic RF energy illuminating the surface.

In an exemplary embodiment, a tunable impedance surface, such as those described and shown with respect to FIGS. 4A, 4B, 5A and 5B may be incorporated into a one- or two-dimensionally steerable antenna. FIGS. 8 and 9 illustrate exemplary embodiments of ESA antenna systems.

In an exemplary embodiment, such an antenna may be capable of steering a beam of microwave or millimeter wave energy in one or two dimensions, using a set of electrical control signals. In an exemplary embodiment, the tunable textured surface 1 may be used in an antenna in at least one of two ways: (1) a sparse-feed mode (FIG. 8) or (2) a reflect array mode (FIG. 9).

FIG. 8 illustrates a schematic diagram of a two-dimensionally steerable tunable, textured impedance surface 800 with an RF feed 815 for use in an ESA antenna system 850.

In an exemplary, sparse-feed mode embodiment, RF energy is supplied to elements 809 of the tunable, textured surface 800 from an array of radiating elements 819 which may be more sparsely spaced than other array applications or embodiments. In an exemplary embodiment, the radiating elements may be spaced greater than in other, non-tunable-surface phased arrays. For example, in some non-tunable-surface array embodiments, radiating elements may be spaced on the order of about one-half wavelength apart. An exemplary sparse-feed embodiment with a tunable surface 800, on the other hand, may include an array of radiator elements 819 spaced at intervals greater than about ½λ apart or more, including up to at least about 5λ apart. In an exemplary embodiment, the radiator elements 819 may be omni-dimensional radiators and the array may be one-dimensional or two-dimensional. In an exemplary embodiment, the radiators 819 may be spaced evenly throughout the array and may be located about ¼ to ⅒th λ above the tunable surface.

In an exemplary embodiment, the radar system 850 may include a controller 821, a transceiver 820, and a system feed structure 815. In an exemplary embodiment, the system feed structure 815 may include power combiner/dividers 816 and phase shifters 817. In an exemplary embodiment, the controller 821 may control the transceiver 820 to provide an RF signal to the feed structure 815, thereby causing the radiator elements 819 to supply RF energy to the surface 801 by illuminating the surface with radiated RF energy.

In an exemplary embodiment, the tunable textured surface 800 may perform beam steering and signal distribution through surface wave coupling among the elements 819 which may be tunable resonant structures that behave as passive scatterers. In an exemplary embodiment, the elements 809 may be similar to those elements 209, 309 and 409 described above with respect to at least one of FIGS. 3A, 3B, 4A, 4B, 5A and 5B.

In an exemplary embodiment, RF coupling between RF energy of the signal in the surface of the individual elements 819 in the tunable surface 800 may induce currents in the elements 809. The individual elements 809 in the tunable surface may, in turn, radiate energy with the same frequency as the signal. In an exemplary embodiment, the radiation angle or beam angle for the signal radiated by the elements 809 may be controlled, at least in part, by control voltages applied to various varactors spaced across the surface of the tunable surface. In an exemplary embodiment, the control voltages may be provided by the controller 821 through control circuits 807.

In an exemplary embodiment, having fewer emitters or radiators 819 may result in cost savings for a given steerable array application. For example, where the spacing of radiating elements 819 is 5λ as opposed to a more typical ½ λ, there may be 10 times fewer radiators 819 along each of two dimensions, resulting in a factor of 100 times fewer elements per surface area across the array. In an exemplary embodiment, the ability to steer a beam with fewer phase shifters 817 and radiating elements 819 may result in time and cost savings in the manufacture of radar antenna arrays 800. In an exemplary embodiment, the sparser spacing of transmit/receive (T/R) modules makes it easier to fit the T/R modules into the desired lattice spacing. In an array with a more-densely packed feed, on the other hand, the physical size and packaging requirements of the T/R modules may make the ability to fit in the required number of modules difficult.

FIG. 9 illustrates a tunable textured surface 900 for use in an exemplary reflect-array mode. In an exemplary reflect-array mode, a beam of RF or microwave energy may illuminate elements 909 on a surface 906 of the textured surface 900. In an exemplary embodiment, the elements 909 of the tunable surface 900 may radiate or reflect the energy at an angle which may be dependent on the pattern of control voltages applied to various elements 909. In an exemplary embodiment, the resonance frequency of the individual elements 909 on the surface may depend on their individual capacitance, which in turn may be determined or controlled by the control voltages provided to varactors of the tunable surface 900. In an exemplary embodiment, the varactors may be similar to varactors 201, 301, 401 described above with respect to FIGS. 3A, 3B, 4A, 4B, 5A, 5B.

In an exemplary embodiment, a reflection phase of any region of the tunable surface 900 may depend on the frequency of the incoming wave 925 with respect to a resonance frequency of that region. Since the capacitance of the individual varactors may be dependent upon and be controlled by the control or bias voltage applied to each of the corresponding elements 909, the pattern of voltages sets the reflection phase as a function of position across the surface. The radiation pattern of the reflected waves 926 may depend on the gradient of the reflection phase, which may be electronically tuned.

In an exemplary embodiment of a reflect-array mode antenna system 950 may include at least one radiator element 919 and may include a plurality of radiator elements. In an exemplary embodiment, the at least one radiator element 819 may be a horn antenna or other high-directivity feed structure. The radiator element 819 may be located above the tunable surface and arranged to radiate toward the surface 900. In an exemplary embodiment, the radiator element 919 or horn may be located far enough above the surface so that it illuminates the whole surface. Having the radiator element 919 any further away may lead to lost power and reduced gain. If more than one radiator element is used, they may be spaced far enough apart so that the illumination area of each horn does not significantly overlap.

In an exemplary embodiment, the radiator 919 may illuminate the tunable surface 901. The surface reflection phase of a reflected beam 926 may depend, in part, on corresponding control voltages. The bias voltages applied to the surface, as a function of position, may determine the angle of the reflected beam 926. In an exemplary embodiment, applying control voltages in a desired gradient across the surface may steer a beam on a desired beam angle.

Figure 10:
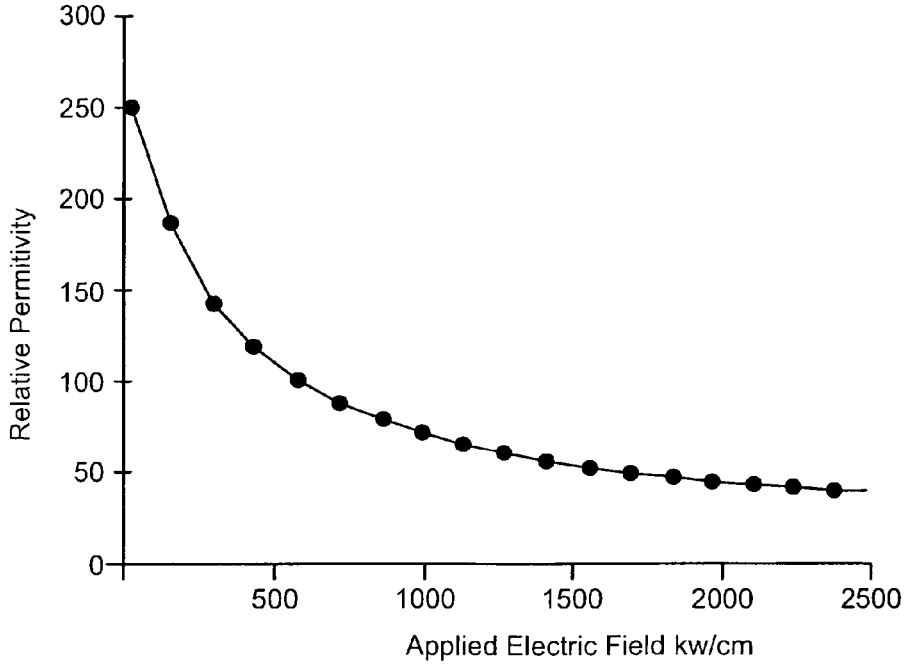
FIG. 10 illustrates the capacitance of an exemplary embodiment of varactors of a tunable surface as a function of voltage.

In an exemplary embodiment, the particular voltages to be applied to the various varactors for inducing a particular, corresponding beam angle may be stored in a table 923 in memory 922. In an exemplary embodiment, a controller 921 may access the table for a desired beam angle and may apply the corresponding voltages to the desired, appropriate varactors. FIG. 10, for example, illustrates an exemplary relationship between applied bias voltage (x-axis in Kv/cm) and relative permittivity (y-axis) of the tunable surface.

In an exemplary embodiment, the gradient of voltages to be applied to various varactors to induce a desired beam angle may be stored, at least in part, as a function. In an exemplary embodiment, the table may store biases corresponding to beam angles for a plurality of angles. The number of angles and the angular displacement between such angles may depend, at least in part, on the angular resolution of the array. In an exemplary embodiment, the resolution of an array may be, for example, about 5 degrees.

In an exemplary embodiment, the gradient of voltages applied to varactors across a tunable surface may approximate a saw tooth wave as illustrated in FIG. 11. The saw tooth wave may apply higher voltages at the high point of the saw tooth and progressively lower, for example about linearly lower, as the saw tooth extends in a direction. In an exemplary embodiment, the saw tooth may repeat. In an exemplary embodiment, a saw tooth may be used in an x direction and another saw tooth may be used in a corresponding y direction.

In an exemplary embodiment, the angle of reflection of radiation incident on the surface of a tunable surface may be steered by application of desired bias voltages to individual varactor elements in the surface. In an exemplary embodiment, phase discontinuities of $2\pi$ may be used to steer angles of desired magnitude. In an exemplary embodiment, the bias voltages may be result in a sawtooth pattern of reflection phase across a surface. In an exemplary embodiment, a controller controls the bias voltage to elements across the surface to achieve the desired reflection phase across the surface. In an exemplary embodiment, the phase discontinuity pattern may resemble a radio-frequency Fresnel parabolic reflector.

It is understood that the above-described embodiments are merely illustrative of the possible specific embodiments which may represent principles of the present invention. Other arrangements may readily be devised in accordance with these principles by those skilled in the art without departing from the scope and spirit of the invention. The terms top and bottom and up and down are used herein for convenience to designate relative spatial relationships among various features in various embodiments.

What is claimed is:

1. An electronically scanned antenna comprising:

at least one radiator element;

a tunable impedance surface located for illumination by the at least one radiator element, wherein the tunable surface comprises a solid state monolithic device, said device comprises a first plurality of conductive elements connected to corresponding bias lines and a second plurality of conductive elements connected to a ground plane, wherein the first plurality of conductive elements are connected to corresponding, neighboring ones of the second plurality of conductive elements by a respective varactor comprising a ferroelectric material;

a controller for controlling bias voltages applied to the bias lines, wherein the varactor comprises barium strontium titanate (BST).

2. The electronically scanned antenna of claim 1, wherein the varactor comprises a bottom electrode, first and second barium strontium titanate (BST) elements arranged on top of the bottom electrode, and first and second top electrode portions arranged on top of the first and second BST elements respectively.

3. The electronically scanned antenna of claim 1, further comprising:

a RF feed comprising a plurality of power dividers and a plurality of phase shifters; and a plurality of radiator elements corresponding to the plurality of phase shifters and arranged in an array, wherein the plurality of radiator elements are spaced a distance apart in a range from greater than one half of a wavelength of an operating frequency and up to about five wavelengths.

4. The electronically scanned antenna of claim 1, wherein the at least one radiator comprises a horn antenna or a high-directivity feed structure.

5. The electronically scanned antenna of claim 1, wherein each varactor comprises a bottom electrode, first and second barium strontium titanate (BST) elements arranged on top of the bottom electrode, and first and second top electrode portions arranged on top of the first and second BST elements respectively.

6. The electronically scanned antenna of claim 1, wherein the at least one radiator element comprises a plurality of radiator elements arranged in an array, wherein the plurality of radiator elements are spaced a distance apart in a range from greater than one half of a wavelength of an operating frequency and up to about five wavelengths.

7. The electronically scanned antenna of claim 1, wherein the at least one radiator comprises a horn antenna, an omnidirectional antenna or a high-directivity feed structure.

8. An electronically scanned antenna for steering a beam of microwave or millimeter wave energy, comprising:

a substrate;

a ground plane disposed on a back surface of the substrate;

a periodic metallic pattern fabricated on a front surface of the substrate;

a set of varactors formed on the front surface and comprising a ferroelectric material, said material comprising barium strontium titanate (BST);

a set of control lines connected to the periodic metallic pattern to apply a set of bias voltages to the set of varactors; and a circuit for supplying the bias voltages to the set of control lines;

wherein the periodic metallic pattern comprises a first plurality of conductive elements connected to corresponding control lines and a second plurality of conductive elements connected to the ground plane, wherein the first plurality of conductive elements are connected to corresponding, neighboring ones of the second plurality of conductive elements by respective varactors of the set of varactors.

* * * * *